United States Patent [19]

Matsumura

[11] Patent Number: 4,535,744

[45] Date of Patent: Aug. 20, 1985

[54] FUEL CUT-SUPPLY CONTROL SYSTEM FOR MULTIPLE-CYLINDER INTERNAL COMBUSTION ENGINE

[75] Inventor: Ryouichi Matsumura, Ebina, Japan

[73] Assignee: Nissan Motor Company, Limited, Yokohama, Japan

[21] Appl. No.: 465,198

[22] Filed: Feb. 9, 1983

[30] Foreign Application Priority Data

Feb. 10, 1982 [JP] Japan ..... 57-18907

[51] Int. Cl.[3] ..... F02D 17/00

[52] U.S. Cl. ..... 123/493; 123/325; 123/481

[58] Field of Search ..... 123/198 F, 325, 326, 123/332, 333, 472, 481, 492, 493

[56] References Cited

U.S. PATENT DOCUMENTS

| | | | |
|---|---|---|---|
| 4,172,434 | 10/1979 | Coles | 123/481 |
| 4,276,863 | 7/1981 | Sugasawa et al. | 123/325 |
| 4,311,123 | 1/1982 | Glöckler et al. | 123/325 |
| 4,353,342 | 10/1982 | Sugasawa et al. | 123/493 |
| 4,357,924 | 11/1982 | Sugasawa et al. | 123/493 |
| 4,364,349 | 12/1982 | Miyagi et al. | 123/325 |
| 4,437,442 | 3/1984 | Yamaguchi | 123/493 |

FOREIGN PATENT DOCUMENTS

| | | |
|---|---|---|
| 45648 | 12/1974 | Japan . |
| 38781 | 9/1981 | Japan . |

*Primary Examiner*—Parshotam S. Lall
*Assistant Examiner*—W. R. Wolfe
*Attorney, Agent, or Firm*—Schwartz, Jeffery, Schwaab, Mack, Blumenthal & Evans

[57] ABSTRACT

A fuel cut-supply control system for a multiple-cylinder internal combustion engine which can effectively prevent engine vibration or shock generated when fuel is cut off or resupplied. The cylinders of the engine are divided into two cylinder groups and fuel is cut off or resupplied to one cylinder group a predetermined delay time after fuel has been cut off from or resupplied to the other cylinder group. The delay time is so determined that vibration caused by the first cylinder group is 180 degrees out of phase with that caused by the second cylinder group. The control system according to the present invention comprises a delay circuit and a first and second fuel cut-supply control sections, in addition to the conventional fuel cut-supply control system.

6 Claims, 20 Drawing Figures

VIBRATION
TORQUE
1ST GROUP
t1
t2
O
t

Δt = T/2
VIBRATION
TORQUE
2ND GROUP
t1
t2
O
t

T/2
VIBRATION
ENGINE
TORQUE
t1
t2
O
t

FUEL SUPPLY COMMAND SIG Ss FROM 5

FUEL INJECTION PULSE P1 TO CYL 7
Δt

FUEL INJECTION PULSE P2 TO CYL 8

ENGINE TORQUE

CAR BODY VIBRATION (WHEN ACCELERATED)

FUEL CUT-SUPPLY CONTROL SYSTEM FOR MULTIPLE-CYLINDER INTERNAL COMBUSTION ENGINE

BACKGROUND OF THE INVENTION

1. Field of the Invention

The present invention relates generally to a fuel control system for a multiple-cylinder internal combustion engine and particularly to a fuel cut-supply control system for an automotive vehicle by which fuel supplied into engine cylinders is automatically cut temporarily when the engine is being decelerated and supplied again when the engine is being accelerated.

2. Description of the Prior Art

There are will known some electronic fuel control systems for automotive vehicles which can economize fuel supplied into engine cylinders by cutting fuel temporarily or by reducing the amount of fuel only when the engine is being decelerated.

As a first prior-art fuel supply control system, there exists the one which comprises a fuel injection pulse generating section for generating a fuel injection pulse having an adequate pulse width in response to sensor signals indicative of engine speed and the amount of intake air, a fuel-cut determination section for generating a fuel-cut command signal in response to other sensor signals indicative of engine speed and throttle valve position, and a fuel-cut control section for allowing the fuel injection pulse to pass therethrough to fuel injection valves when no fuel-cut command signal is generated (when the engine is being accelerated) and allowing the fuel injection pulse not to pass therethrough to the fuel injection valves when a fuel-cut command signal is generated (when the engine is being decelerated).

In such a prior-art fuel supply control system, however, since the fuel is abruptly cut off from or resupplied into the engine cylinders when the engine is decelerated or accelerated, there exists a problem in that the engine vibrates excessively, thus resulting in poor riding comfort.

A more detailed description of this first prior-art fuel supply control system will be made hereinafter with reference to the attached drawings under DETAILED DESCRIPTION OF THE PREFERRED EMBODIMENTS.

Further, as a second prior-art fuel supply control system, there exists an electronic fuel injection system, as disclosed in Japan Patent No. Showa 49-45648, which comprises a fuel injection pulse generation section for generating a fuel injection pulse having an adequate pulse width according to at-least one engine operating parameter, a switch closed when the engine is accelerated, and a monostable circuit triggered when the switch is closed and outputting a signal to adjust the pulse width of the fuel injection pulse outputted from the fuel injection pulse generation section, in order to increase the amount of fuel only when the engine is being accelerated.

In such a prior-art fuel supply control system, similarly, since the pulse width of a fuel injection pulse is abruptly increased for increase in fuel supplied into the engine cylinders when the engine is accelerated, there exists the same problem as in the first prior-art fuel supply control system in that the engine vibrates excessively, thus resulting in poor riding comfort.

Furthermore, as a third prior-art fuel supply control system, there exists a system of supplying fuel into engine cylinders, as disclosed in Japan Patent No. Showa 56-38781, which comprises a calculating section for generating a fuel injection pulse having an adequate pulse width in accordance with engine status, a fuel-cutting section for outputting a fuel-cut command signal when the engine is decelerated, and a fuel-resupply compensation section for generating a compensation command signal the level of which changes gradually after no fuel-cut command signal has been outputted, in order to gradually increase the pulse width of the fuel injection pulse outputted from the calculating section.

In such a prior-art fuel supply control system, since the pulse width of a fuel injection pulse is gradually increased for increase in fuel supplied into the engine cylinders when the engine is accelerated, an excessive vibration may be reduced in the engine; however, there exists another problem in that the engine torque is not quickly increased immediately after the engine is accelerated.

SUMMARY OF THE INVENTION

With these problems in mind, therefore, it is the primary object of the present invention to provide a fuel cut-supply control system for a multiple-cylinder internal combustion engine which can effectively prevent engine vibration or shock generated when fuel is cut off during engine deceleration or when fuel is resupplied during engine acceleration.

To achieve the above-mentioned object, in the fuel cut-supply control system for the multiple-cylinder internal combustion engine according to the present invention, the cylinders of the engine are divided into two cylinder groups and fuel is cut off from or resupplied to one cylinder group a predetermined time after being cut off from or resupplied to the other cylinder group, whenever the engine is decelerated or accelerated. The delay time is so determined that vibration caused by the first cylinder group is 180 degrees out of phase with that caused by the second cylinder group; in other words, that two vibrations caused by the first and second cylinder groups cancel each other.

The fuel cut-supply control system according to the present invention comprises an intake air amount sensor, an engine speed sensor, a throttle valve position sensor, a fuel injection pulse generating section for calculating an appropriate pulse width of a fuel injection pulse signal applied to the fuel injection valves, a fuel cut-supply determination section for outputting a fuel supply command signal when engine speed is below a predetermined value and the engine is being accelerated (when the throttle valve is not fully closed) and a fuel cut command signal when engine speed is above a predetermined value and the engine is being decelerated (when the throttle valve is fully closed), a delay circuit for delaying the fuel supply command signal or the fuel cut command signal, a first fuel cut-supply control section for applying the fuel injection pulse signal to the first engine cylinder group in respnse to the fuel supply command signal and interrupting the fuel injection pulse signal in response to the fuel cut command signal, and a second fuel cut-supply control section for applying the fuel injection pulse signal to the second engine cylinder group in response to the delayed fuel supply command signal and interrupting the fuel injection pulse signal in response to the delayed fuel-cut command signal.

BRIEF DESCRIPTION OF THE DRAWINGS

The features and advantages of the fuel cut-supply control system for a multiple-cylinder internal combustion engine according to the present invention over the prior-art fuel control system will be more clearly appreciated from the following description of the preferred embodiments of the invention taken in conjunction with the accompanying drawings in which like reference numerals designate the same or similar elements or sections throughout the figures thereof and in which.

DETAILED DESCRIPTION OF THE PREFERRED EMBODIMENTS

To facilitate understanding of the present invention, a brief reference will be made to a typical prior-art fuel cut-supply control system for a multiple-cylinder internal combustion engine, with reference to the attached drawings.

Figure 1:
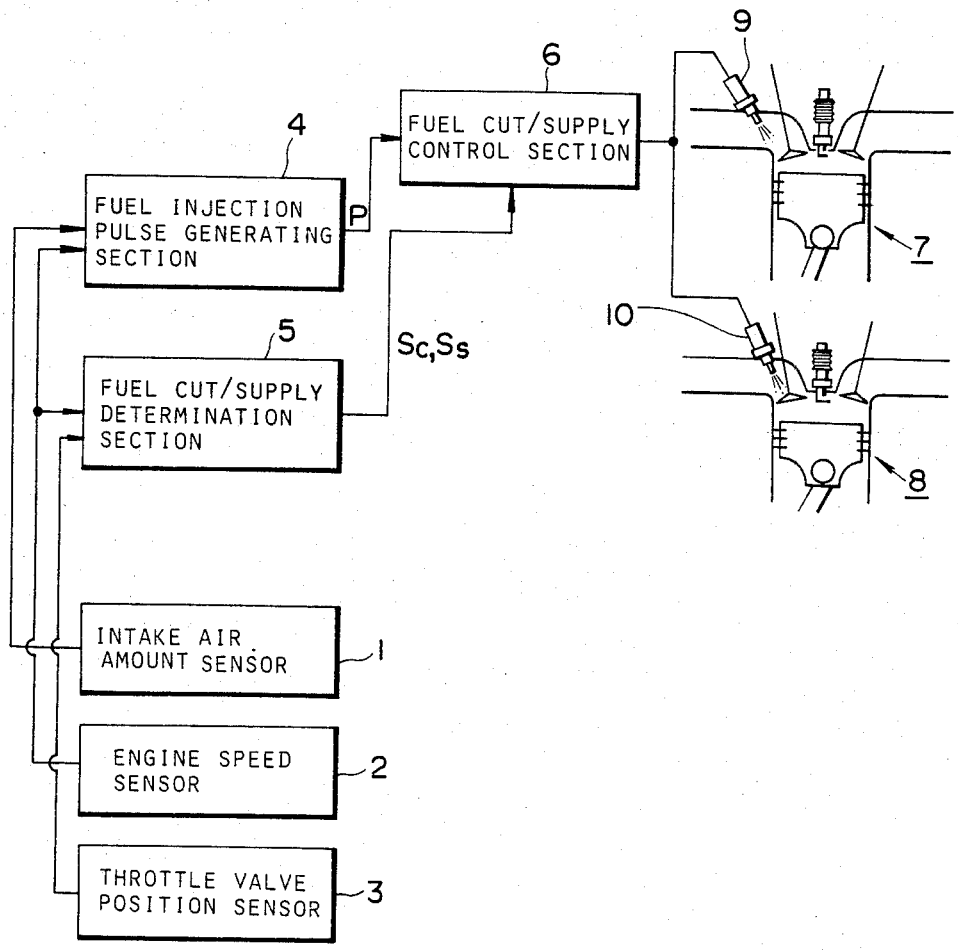
FIG. 1 PRIOR ART
FIG. 1 is a schematic block diagram, partly in diagrammatic illustration, of a typical prior-art fuel cut-supply control system.
Figure 2:
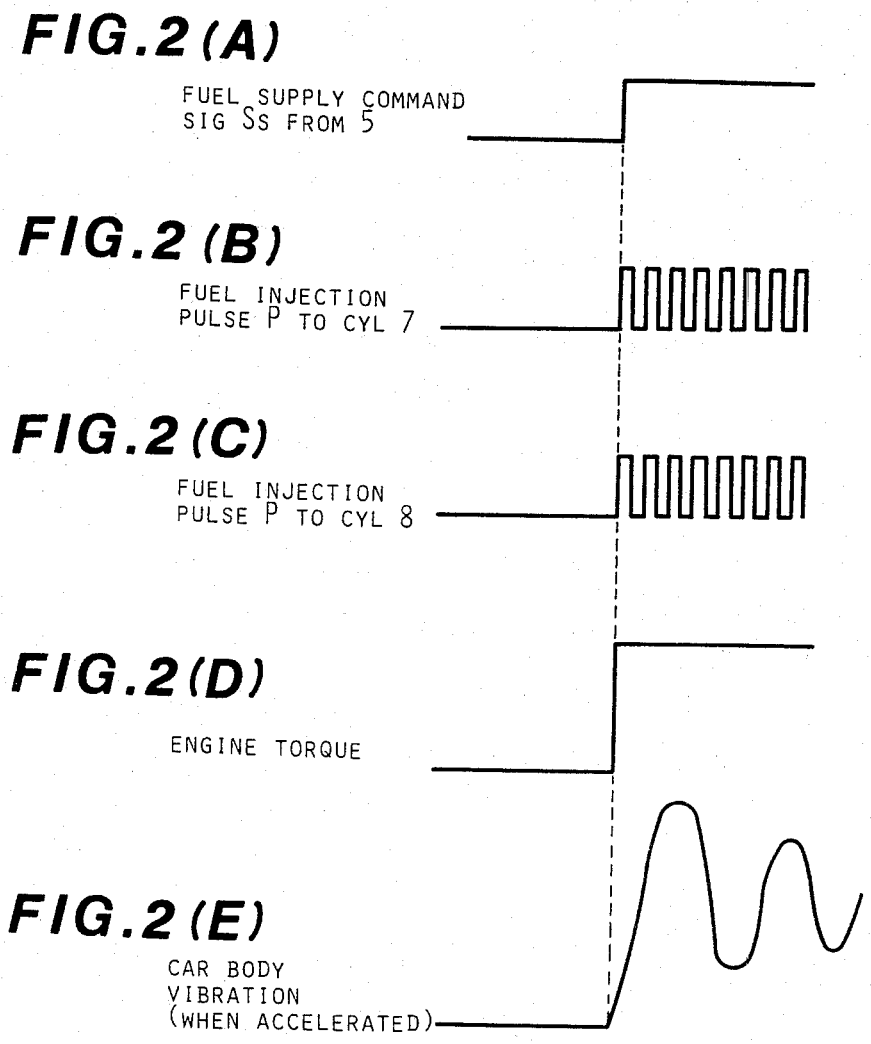
FIG.2 PRIOR ART
FIG. 2(A) is a waveform chart of a fuel supply command signal $S_s$ outputted from the fuel cut-supply determination section shown in FIG. 1.
FIG. 2(B) is a waveform chart of a fuel injection pulse P outputted from the fuel cut-supply control section to a cylinder 7 shown in FIG. 1.
FIG. 2(C) is a waveform chart of a fuel injection pulse P outputted from the fuel cut-supply control section to a cylinder 8 shown in FIG. 1.
FIG. 2(D) is a graphical representation of engine torque generated in the prior-art fuel cut-supply control system shown in FIG. 1.
FIG. 2(E) is a waveform chart of car body vibration generated in the prior-art fuel cut-supply control system shown in FIG. 1.

In FIG. 1, the reference numeral 1 denotes an intake air mount sensor for detecting the amount of intake air; the reference numeral 2 denotes an engine speed sensor for detecting the speed of an engine; the reference numeral 3 denotes a throttle valve position sensor for detecting the position or the opening rate of a throttle valve. By detecting the opening rate, it is possible to detect that the engine is being decelerated (that is, idled) or accelerated, because the throttle valve is fully closed when the engine is decelerated and opened when the engine is accelerated.

The reference numeral 4 denotes a fuel injection pulse generating section for calculating an appropriate pulse width of a fuel injection pulse signal P in response to two sensor signals outputted from the intake air amount sensor 1 and the engine speed sensor 2 and for outputting a fuel injection pulse signal P.

The reference numeral 5 denotes a fuel cut-supply determination section for determining whether or not the fuel injection pulse P should be applied to fuel injection valves in response to two sensor signals outputted from the engine speed sensor 2 and the throttle valve position sensor 3 and for outputting a fuel-cut command signal $S_c$ when the engine speed exceeds a predetermined value and the throttle valve is fully closed (being idled) or a fuel-supply command signal $S_s$ when the engine speed drops below another predetermined value and the throttle valve is opened (being accelerated).

The reference numeral 6 denotes a fuel cut-supply control section for not passing the fuel injection pulse P outputted from the fuel injection pulse generating section 4 to fuel injection valves 9 and 10 when the fuel cut-supply determination section 5 outputs a fuel-cut command signal $S_c$ thereto but for passing the fuel injection pulse P when the fuel cut-supply determination section 5 outputs a fuel-supply command signal $S_s$ thereto.

Hereupon, the valve 9 is provided for a first engine cylinder 7 and the valve 10 is provided for a second engine cylinder 10, respectively. Although only two engine cylinders 7 and 8 are illustrated, in the case of a multiple-cylinder engine, the first engine cylinder 7 is assumed to be a first engine cylinder group including No. 1, No. 2 and No. 3, for instance, and the second engine cylinder 8 is assumed to be a second engine cylinder group including No. 4, No. 5, and No. 6, for instance, in the case of a six-cylinder engine.

In such a prior-art fuel cut-supply control system, the fuel cut-supply determination section 5 determines that the engine is decelerated (idled) on the basis of the negative differential value of engine speeds detected by the engine speed sensor 2 and/or the released throttle valve position detected by the throttle valve position sensor 3 and outputs a fuel cut command signal $S_c$ to the fuel cut-supply control section 6. In response to this fuel-cut command signal $S_c$, the fuel cut-supply control section 6 closes a gate to inhibit the fuel injection pulse P from being applied to the fuel injection valves 9 and 10.

Therefore, no fuel is supplied into the engine cylinders to economize fuel when the accel pedal is released or when the engine is being decelerated or idled.

On the other hand, the fuel cut-supply determination section 5 determines that the engine is accelerated on the basis of the positive differential value of engine speeds detected by the engine speed sensor 2 and/or the depressed throttle valve position detected by the throttle valve position sensor 3 and outputs a fuel supply command signal $S_s$ to the fuel cut-supply control section 6. In response to this fuel supply command signal $S_s$, the fuel cut-supply control section 6 opens the gate to pass the fuel injection pulse P to the fuel injection valves 9 and 10. Therefore, fuel is supplied into the engine cylinders to generate engine torque when the accelerator pedal is depressed or when the engine is being accelerated.

FIG. 2(A) to FIG. 2(E) show the timing chart of the fuel supply command signal $S_s$, the fuel injection pulse P, and engine torque and engine (i.e. car body) vibration caused by the change in engine torque.

As depicted in these figures, the instant the fuel cut-supply determination section 5 outputs a fuel-supply command signal $S_s$ to the fuel cut-supply control section 6, since the fuel injection pulse P is supplied to the fuel injection valves 9 and 10 simultaneously, fuel is supplied into the cylinders 7 and 8 simultaneously, thus resulting in a problem in that engine torque increases abruptly and therefore the engine or car body begins to vibrate violently. The vibration thus caused may deteriorate riding comfort in an automotive vehicle.

In view of the above description, reference is now made to a first embodiment of the fuel cut-supply control system for a multiple-cylinder internal combustion engine according to the present invention.

Figure 3:
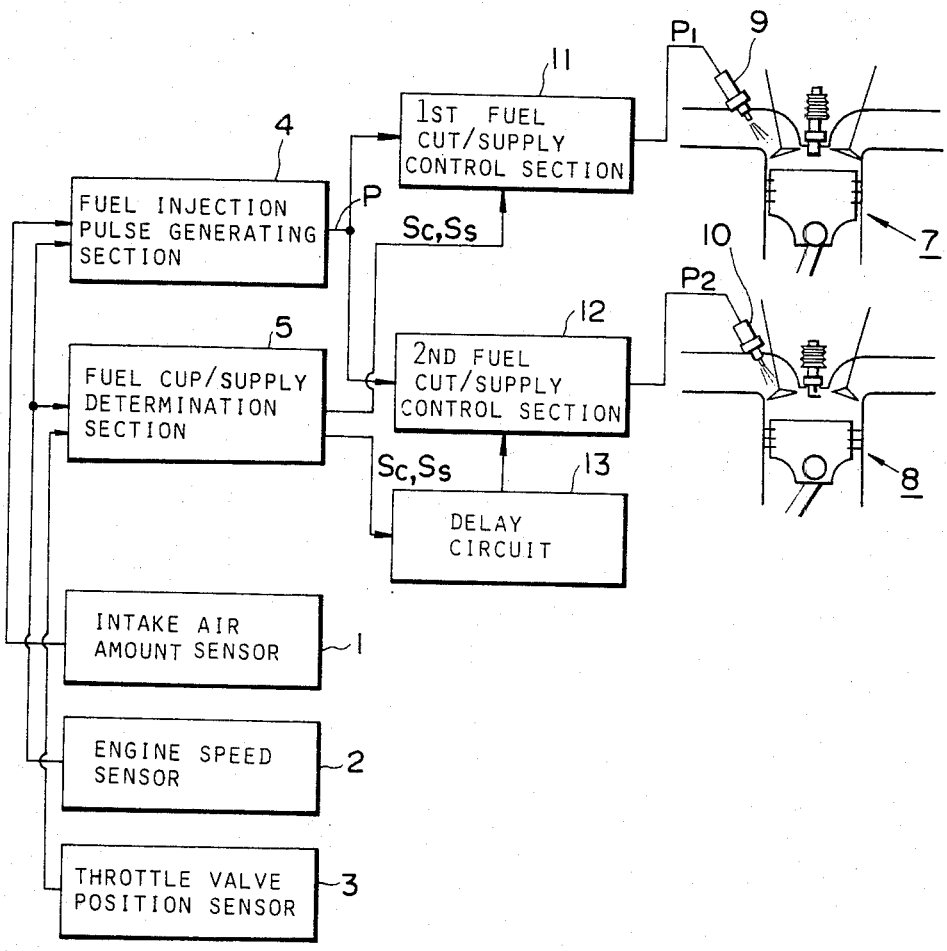
FIG. 3 is a schematic block diagram, partly in diagrammatic illustration, of a first embodiment of the fuel cut-supply control system according to the present invention.

As depicted in FIG. 3, the control system according to the present invention comprises an intake air amount sensor 1 for detecting the amount of intake air, an engine speed sensor 2 for detecting the speed of an engine, a throttle valve position sensor 3 for detecting the position or the opening rate of a throttle valve, a fuel injection pulse generating section 4 for calculating an appropriate pulse width of a fuel injection pulse signal P in response to two sensor signals outputted from the intake air amount sensor 1 and the engine speed sensor 2 and for outputting a fuel injection pulse signal P, a fuel cut-supply determination section 5 for determining whether or not the fuel injection pulse P should be applied to fuel injection valves in response to two sensor signals outputted from the engine speed sensor 2 and the throttle valve position sensor 3 and for outputting a fuel cut command signal $S_c$ when the engine is decelerated and a fuel supply command signal $S_s$ when the engine is accelerated, in the same manner as in the prior-art fuel cut-supply control system as already described with reference to FIG. 1. Additionally, two injection valves 9 and 10 are provided for two engine cylinders 7 and 8, respectively. As described in the prior-art system shown in FIG. 1, in this embodiment, the first engine cylinder 7 is assumed to be a first engine cylinder group (e.g. No. 1, NO. 2, and No. 3) and the second engine cylinder 8 is assumed to be a second engine cylinder group (i.g. No. 4, No. 5 and No. 6). Therefore, the first fuel-ignition valve 9 should be considered herein as a plurality of valves installed for each engine cylinder of the first engine cyliner group 7, independently; the second fuel-ignition valve 10 should be considered as a plurality of valves installed for each engine cylinder of the second engine cylinder group 8, independently.

However, being different from the prior-art system shown in FIG. 1, this first embodiment according to the present invention comprises two first and second fuel cut-supply control sections 11 and 12 for the fuel injection valves 9 and 10, respectively, and additionally a delay circuit 13.

This delay circuit 13 is connected between the fuel cut-supply determination section 5 and the second fuel cut-supply control section 12 to delay the fuel-cut command signal $S_c$ and the fuel-supply command signal $S_s$ by a predetermined time period.

A fuel injection pulse signal P generated from the fuel injection pulse generating section 4 is applied to the first fuel injection group 9 via the first fuel cut-supply control section 11 and to the second fuel injection group 10 via the second fuel cut-supply control section 12. Further, the fuel-cut or fuel-supply command signal $S_c$ or $S_s$ is directly applied to the first fuel cut-supply control section 11 and indirectly applied to the second fuel cut-supply control section 12 through the delay circuit 13.

Therefore, the fuel-cut or fuel-supply command signal $S_c$ or $S_s$ is applied to the secnd fuel cut-supply control section 12 a predetermined time period after the command signal $S_c$ or $S_s$ has been applied to the first fuel cut-supply control section 11.

This delay time $\Delta t$ is so determined as to be a half periodic time T/2 (approximately 0.1 to 0.6 sec) of the natural vibration of the power train system including the internal combustion engine and the other related elements, irrespective of vehicle speed or engine speed, in order to cancel one engine vibration caused by the first cylinder group by the other engine vibration caused by the second cylinder group or vice versa.

Figure 4:
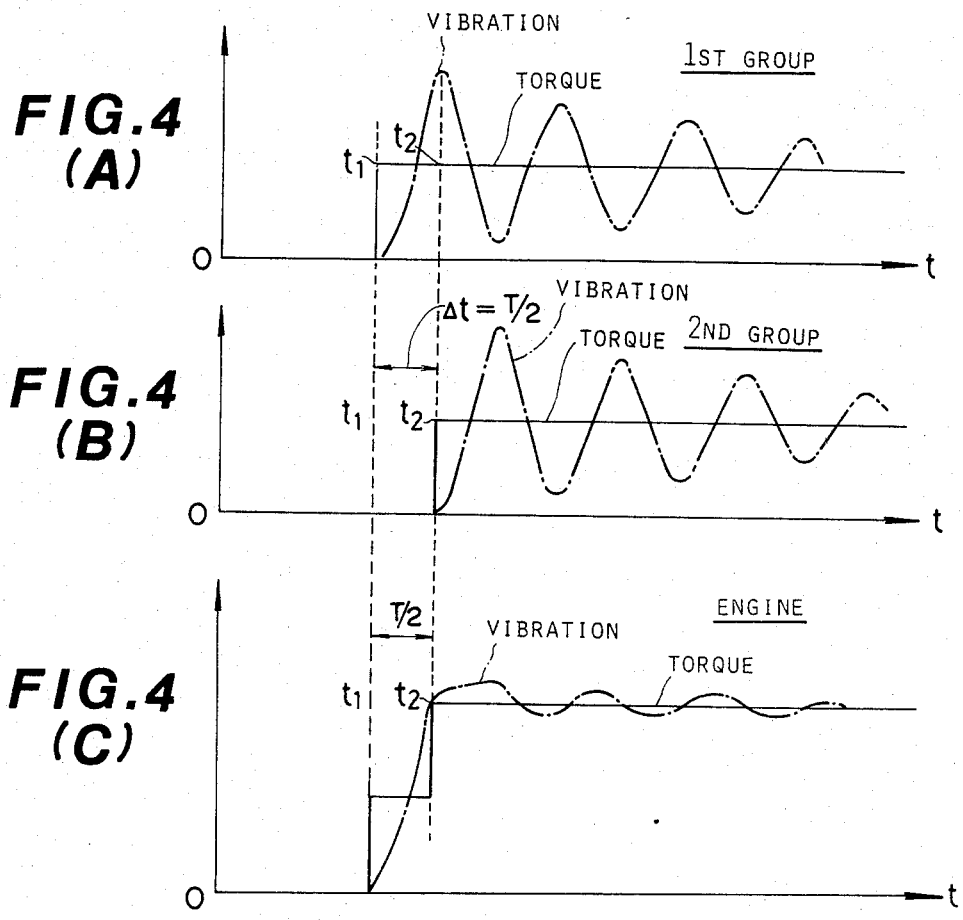
FIG. 4(A) is a graphical representation of engine torque and a waveform chart of car body vibration generated in one cylinder group, in the fuel cut-supply control system according to the present invention shown in FIG. 3.
FIG. 4(B) is a graphical representation of engine torque and a waveform chart of car body vibration generated in the other cylinder group, in the fuel cut-supply control system according to the present invention shown in FIG. 3.
FIG. 4(C) is a graphical representation of engine torque and a waveform chart of car body vibration generated in the entire engine cylinders, in the fuel cut-supply control system according to the present invention shown in FIG. 3.

The effect of this delay time $\Delta t$ will be described in greater detail hereinbelow with reference to FIGS. 4(A), 4(B) and 4(C). When fuel is supplied to the first engine cylinder group 7 at the time $t_1$, the engine torque rises abruptly and is kept at a constant level and thereby the engine begins to vibrate as depicted in FIG. 4(A). On the other hand, when fuel is supplied to the second engine cylinder group 8 at the time $t_2=t_1+\Delta t$, the engine torque also rises abruptly and is kept at a constant level and thereby the engine begins to vibrate as depicted in FIG. 4(B). In this case, since the vibration periodic time T of the first engine cylinder group is equal to that of the second engine cylinder group and since engine vibration of the first group is 180 degrees out of phase with that of the second group or vice versa, the peak value of one vibration caused by the first engine cylinder group matches with the bottom value of the other vibration caused by the second engine cylinder group, thus the vibrations of both the engine cylinder groups cancel each other, as depicted in FIG. 4(C).

The operation of the first embodiment will be described hereinbelow.

When the engine is being idled or decelerated, the throttle valve position sensor 3 detects that the throttle value is fully closed and outputs a signal indicative of engine idling. On the other hand, the engine speed sensor 2 detects the engine speed and outputs a signal indicative of engine speed. The fuel cut-supply determination section 5 is activated in response to the engine idling signal outputted from the throttle valve position sensor 3 in order to compare the engine speed outputted from the engine speed sensor 2 with a predetermined value. If the engine speed exceeds the predetermined value, the determination section 5 determines that fuel should be cut and outputs a fuel cut command signal $S_c$; if the engine speed drops below the predetermined value, the determination section 5 determines that fuel should be supplied and outputs a fuel supply command signal $S_s$.

In contrast with this, when the engine is being accelerated, the throttle valve position sensor 3 detects that the throttle valve is opened and outputs a signal indicative of engine acceleration. The fuel cut-supply determination section 5 is activated in response to the engine acceleration signal outputted from the throttle valve position sensor 3 in order to determine that fuel should be supplied and output a fuel supply command signal $S_s$.

On the other hand, the fuel injection pulse generating section 4 is calculating an optimum pulse width of a fuel injection pulse signal P on the basis of the two sensor signals outputted from the intake air amount sensor 1 and the engine speed sensor 2 and outputting the calculated fuel injection pulse signal P to the first and second fuel cut-supply control sections 11 and 12, respectively.

In the case where the fuel cut-supply determination section 5 outputs a fuel cut command signal $S_c$, the first fuel cut-supply control section 11 immediately closes a gate to inhibit the fuel injection pulse P from being applied to the first fuel injection valve group 9. However, the second fuel cut-supply control section 12 closes a gate, $\Delta t=(T/2)$ after the first fuel cut-supply control section 11 has closed the gate, to inhibit the fuel injection pulse P from being applied to the second fuel injection valve group 10.

Therefore the engine damping vibration caused by the first engine cylinder group 7 is canceled by that caused by the second engine cylinder group 8 or vice versa, thus reducing the amplitude of engine damping vibration as compared with the case where fuel is simultaneously cut to both the first and second fuel injection valve groups 9 and 10.

Similarly, in the case where the fuel cut-supply determination section 5 outputs a fuel supply command signal $S_s$, the first fuel cut-supply control section 11 immediately opens the gate to pass the fuel injection pulse P to the first fuel injection valve group 9. However, the second fuel cut-supply control section 12 opens the gate, $\Delta t=(T/2)$ after the first fuel cut-supply control section 11 has opened the gate, to pass the fuel injection pulse P to the second fuel injection valve group 10.

Therefore, the engine starting vibration caused by the first engine cylinder group 7 is canceled by that caused by the second cylinder group 8 or vice versa, thus reducing the amplitude of engine starting vibration as compared with the case where fuel is simultaneously supplied to both the first and second fuel injection valve groups 9 and 10.

FIGS. 5(A) to 5(E) show the timing chart of the fuel supply command signal $S_s$, the fuel injection pulses $P_1$ and $P_2$, engine torque and engine (i.e. car body) starting vibration caused by the change in engine torque.

Figure 5:
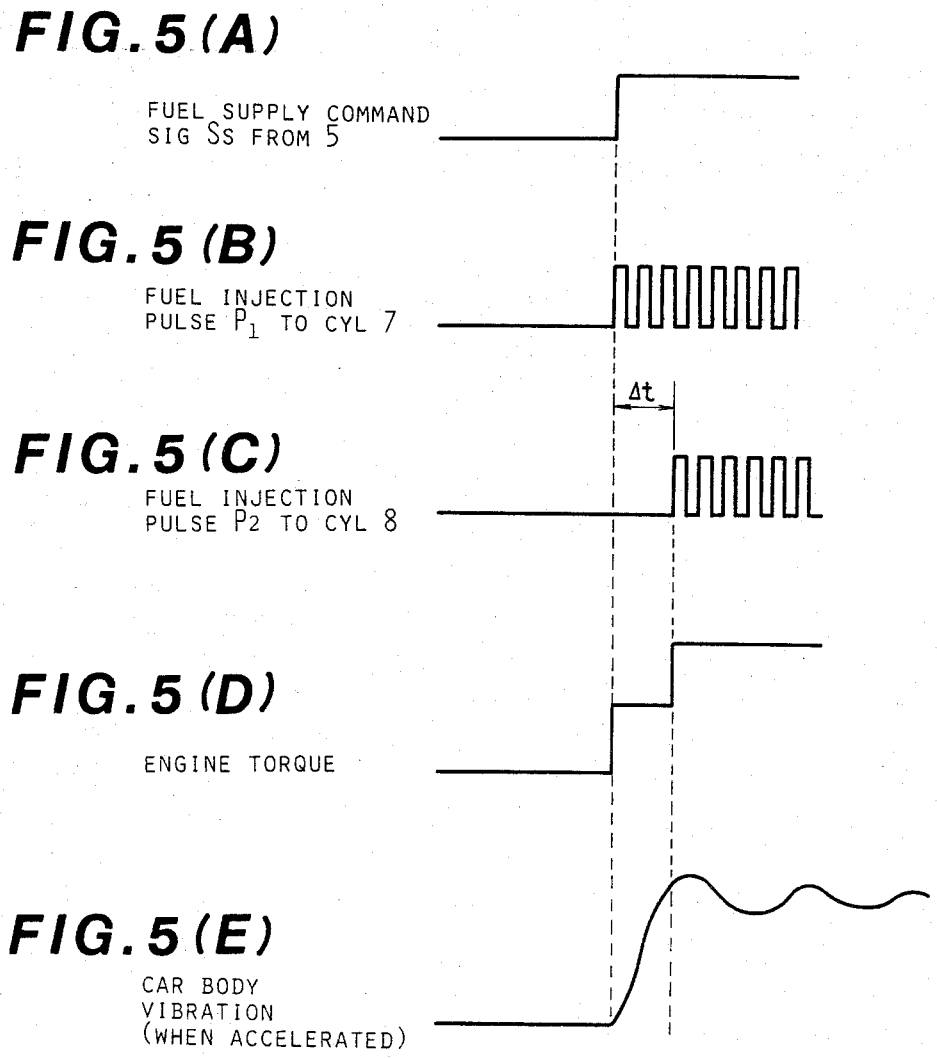
FIG. 5(A) is a waveform chart of a fuel supply command signal $S_s$ outputted from the fuel cut-supply determination section shown in FIG. 3.
FIG. 5(B) is a waveform chart of a first fuel injection pulse $P_1$ outputted from the first fuel cut-supply control section to a cylinder 7 shown in FIG. 3.
FIG. 5(C) is a waveform chart of a second fuel injection pulse $P_2$ outputted from the second fuel cut-supply control section to a cylinder 8 shown in FIG. 3.
FIG. 5(D) is a graphical representation of engine torque generated in the fuel cut-supply control system according to the present invention shown in FIG. 3.
FIG. 5(E) is a waveform chart of car body vibration generated in the fuel cut-supply control system according to the present invention shown in FIG. 3.

Since the fuel injection pulse $P_1$ is directly applied to the first cylinder group 7, as depicted in FIG. 5(B), the instant a fuel supply command signal $S_s$ is generated as shown in FIG. 5(A), the engine torque rises half as depicted in FIG. 5(D). However, when the fuel injection pulse $P_2$ is indirectly applied to the second cylinder group 8 $\Delta t$ time after the same fuel supply command signal $S_s$ has been generated, the engine torque rises full as depicted in FIG. 5(D). Therefore, the two engine vibrations caused at two different timings cancel each other, as depicted in FIG. 5(E).

Further, FIGS. 5(B) and 5(C) show an exemplary case where the number of cylinders is six and therefore the crankshaft rotates over twice while the six cylinders are all ignited within one cycle. In this case, the delay time $\Delta t$ corresponds to one crankshaft revolution or three fuel injection pulses.

Figure 6:
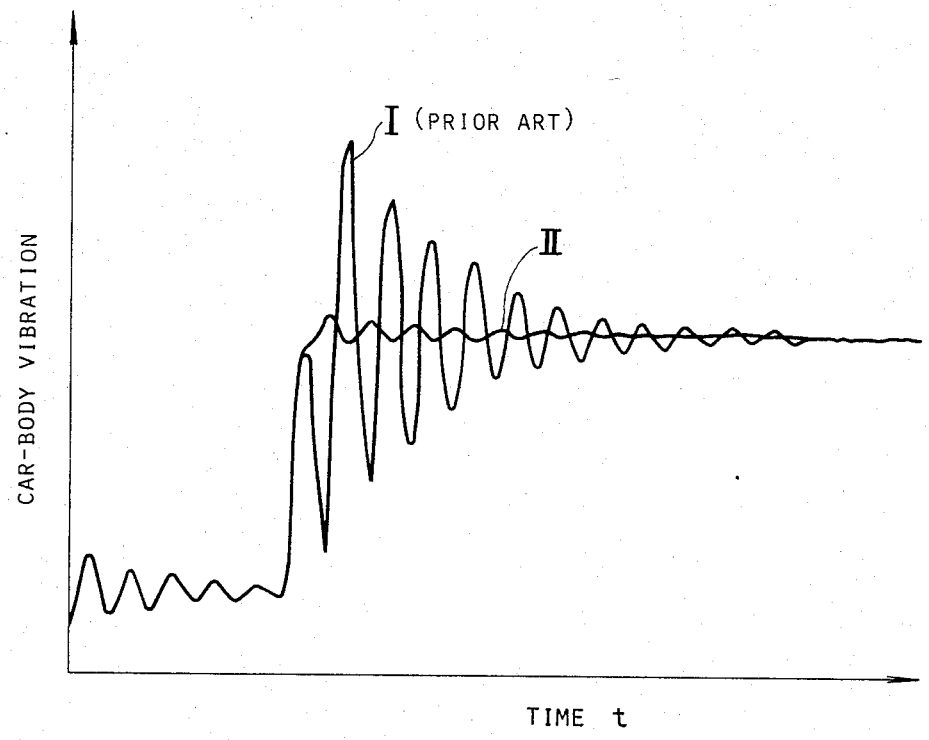
FIG. 6 is enlarged waveform charts of the same car body vibrations shown in FIG. 2(E) (prior art) and FIG. 5(E) (present invention), for comparison of both the vibrations.

Further, FIG. 6 shows an enlarged graphical representation of car body starting vibrations when the engine is accelerated, that is, fuel is supplied. In FIG. 6, label I designates the vibrations caused by the prior-art fuel cut-supply control system (the same as in FIG. 2(E)) and label II designates the vibrations by the fuel cut-supply control system according to the present invention (the same as in FIG. 5(E)), indicating that engine vibration is reduced markedly.

Figure 7:
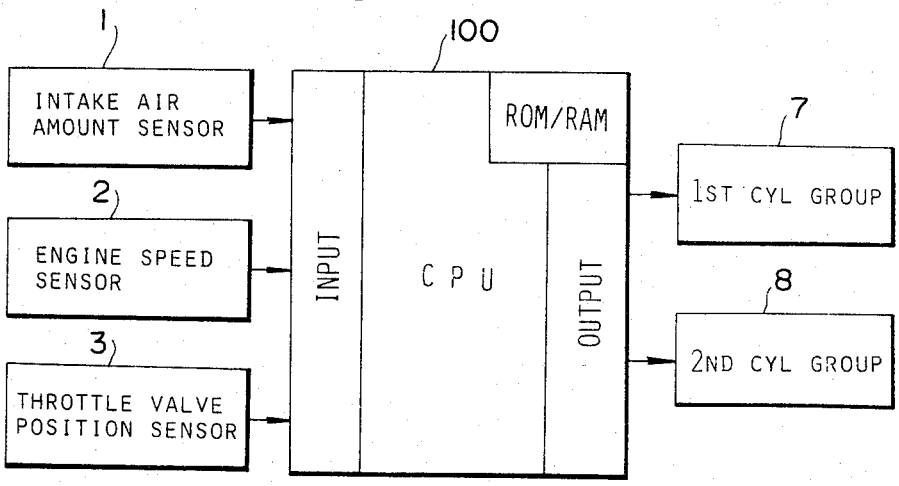
FIG. 7 is a schematic block diagram of a second embodiment of the fuel cut-supply control system according to the present invention, in which a microcomputer is incorporated therein.

FIG. 7 shows a second embodiment of the fuel cut-supply control system according to the present invention. In this embodiment, the fuel pulse generating section 4, the fuel cut-supply determination section 5, the first fuel cut-supply control section 11, the second fuel cut-supply control section 12 and the delay circuit 13 are all incorporated within a microcomputer 100 provided with an input interface, a central processing unit, a read-only memory, a random-access memory, an output interface, etc. In this embodiment, the functions of the fuel pulse generating section 4, the fuel cut-supply determination section 5, the first and second fuel cut-supply control sections 11 and 12 and the delay circuit 13 can be implemented through appropriate arithmetic operations in accordance with appropriate software stored in the read-only memory, in place of hardware.

On the basis of digital signals representative of intake air mount, engine speed and/or throttle valve position inputted into the microcomputer 100 from the intake air amount sensor 1, the engine speed sensor 2 and the throttle valve position sensor 3, the microcomputer 100 calculates an appropriate pulse width of a fuel injection pulse signal P, determines whether or not the fuel injection pulse P should be applied to two fuel injection valves, passes the fuel injection pulse P to the first and second fuel injection valve groups, independently, with a time lag between the two valve groups, in almost the same way as described already with reference to FIG. 3.

FIG. 8 is a flowchart showing the steps of processing the digital signals in greater detail. Program control first checks whether the engine is idling or not on the basis of a detection signal outputted from the throttle valve position sensor 3 (in block 1). When the engine is being idled, the accelerator pedal is released and therefore the throttle valve is fully closed. The throttle valve position sensor 3 detects this state as engine idling. Next, program checks the engine speed on the basis of a detection signal outputted from the engine speed sensor 2 and compares the detected engine speed with one predetermined reference engine speed $N_c$ at which fuel can be cut (in block 2).

Although this predetermined reference engine speed $N_c$ is shown as a fixed value in this flowchart, it is preferable to change this reference engine speed according to engine coolant temperature, as described later. If the detected engine speed N is above the reference speed $N_c$ at which fuel can be cut, the system is checked whether the system is set to the fuel cut mode or not (in block 3). If not set to the fuel cut mode, program control sets the system to the fuel cut mode and further sets a delay time $T_D$ to a fuel cut timer function which is activated the instant the idling is detected (in block 4). Next, fuel is cut off from only the first engine cylinder group (in block 5). Now, program control returns to the initial step (block 1), passing through the block 2, and checks again whether the system is set to the fuel cut mode or not (in block 3). Since the system has already been set to the fuel cut mode, program control advance to block 6, at which the remaining delay time $T_D$ in fuel cut mode is checked. As described later, this delay time $T_{D,CUT}$ is being decremented by another subroutine. When the remaining delay time $T_{D,CUT}$ is positive (in block 6), fuel is kept cut off from only the first engine cylinder group (in block 5). However, if the remaining delay time $T_{D,CUT}$ reaches zero; that is, has elapsed (in block 6), fuel is cut off from both the first and second cylinder groups in order to completely cut fuel from being supplied into the engine (in block 7).

Returning to the initial step (block 1), if the detected engine speed N is below the reference engine speed $N_c$ at which fuel can be cut (in block 2), control advances to block 8, at which the detected engine speed N is checked again whether N exceeds the other predetermined reference engine speed $N_s$ at which fuel should be supplied (in block 8).

Although this predetermined reference engine speed $N_s$ is shown as a fixed value, it is preferable to change this reference engine speed according to engine coolant temperature, as described later. If the detected engine speed N is above the reference speed $N_s$ at which fuel should be supplied (in block 8), control advances to check whether the system is set to the fuel cut mode (in block 9). If the fuel cut mode, control advance to block 6 to check the remaining delay time $T_{D,CUT}$. However, if not the fuel cut mode, that is, the fuel supply mode (in block 9), control advances to block 14, at which fuel is supplied to both the first and second cylinder groups.

If the detected engine speed N is below the reference speed $N_s$ at which fuel should be supplied (in block 8), control advances to block 10 to check whether the system is set to the fuel cut mode (in block 10). If the fuel cut mode, that is, if not yet set to the fuel supply mode, program control sets the system to the fuel supply mode and further sets a delay time $T_{D,SUP}$ to a fuel supply timer function which is activated the instant the engine is accelerated (in block 11). Next, fuel is supplied to only the second engine cylinder group (in block 12). Thereafter, program control returns to the initial step (block 1). Hereupon, since the engine is not idling (in block 1) because fuel is being supplied and the system is set to the fuel mode (in block 10), control advances to block 13, at which the remaining delay time $T_{D,SUP}$ in fuel supply mode is checked. As described later, this delay time $T_{D,SUP}$ is being decremented by another subroutine. When the remaining delay time $T_{D,SUP}$ is positive (in block 13), fuel is kept supplied to only the second engine cylinder group (in block 12). However, if the remaining delay time $T_{D,SUP}$ reaches zero; that is, has elapsed (in block 13), fuel is supplied to both the first and second cylinder groups in order to completely supply fuel into the engine (in block 14), returning to the initial step.

In this moment, since the engine is not being idled (in block 1) and the system is set to fuel supply mode (in block 10), fuel is kept supplied to both the cylinder groups (in block 14).

Figure 8A:
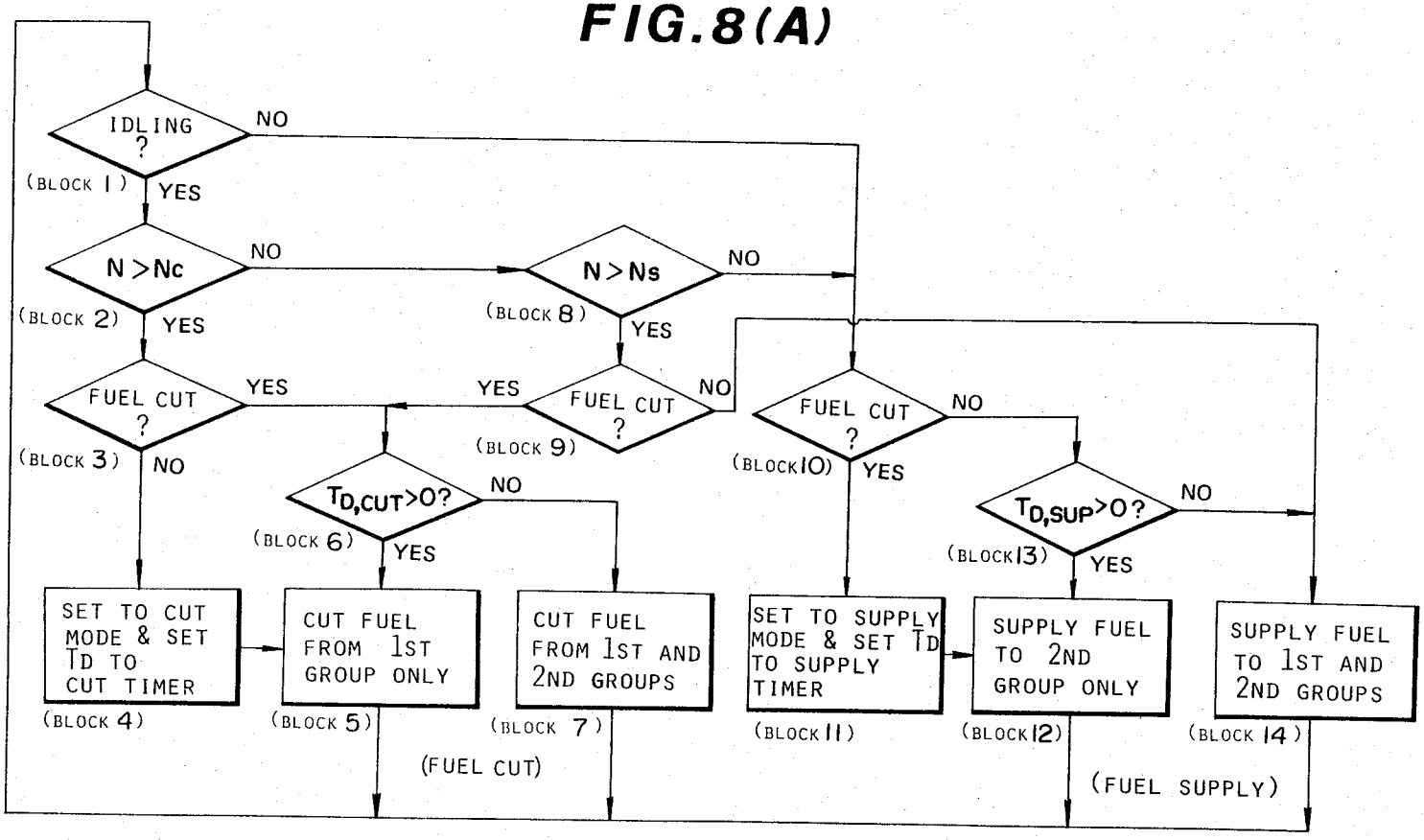
FIG. 8(A) is a flowchart showing the steps of cutting or supplying fuel into engine cylinders in accordance with a program stored in the microcomputer shown in FIG. 7.
Figure 8B:
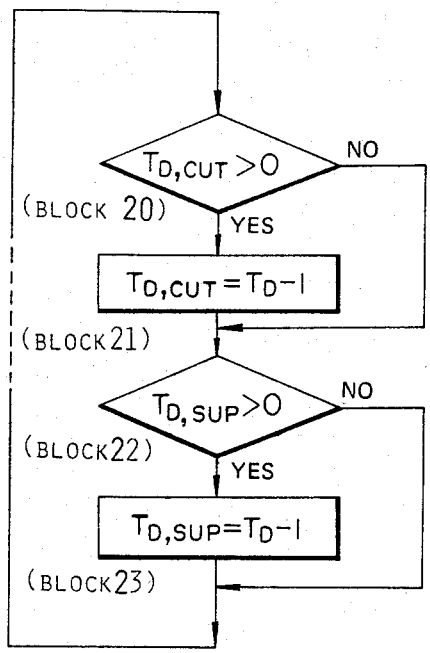
FIG. 8(B) is another flowchart showing the steps of implementing timer functions.

FIG. 8(B) is a flowchart showing the steps of a timer function implemented in accordance with a subroutine.

The instant the delay time $T_{D,CUT}$ is set in block 4 shown in FIG. 8(A), this delay time $T_{D,CUT}$ is greater than zero (in block 20). Therefore, the delay time $T_{D,CUT}$ in the fuel cut mode is decremented (in block 21). If the $T_{D,CUT}$ becomes zero (in block 20), the control advances to block 22 without decrementing the delay time $T_{D,CUT}$.

The instant the delay time $T_{D,SUP}$ is set in block 11 shown in FIG. 8(A), this delay time $T_{D,SUP}$ is greater than zero (in block 22). Therefore, the delay time $T_{D,SUP}$ in the fuel supply mode is decremented (in block 23). If the $T_{D,SUP}$ becomes zero (in block 22), the control returns to the block 20 without decrementing the delay time $T_{D,SUP}$.

Figure 8C:
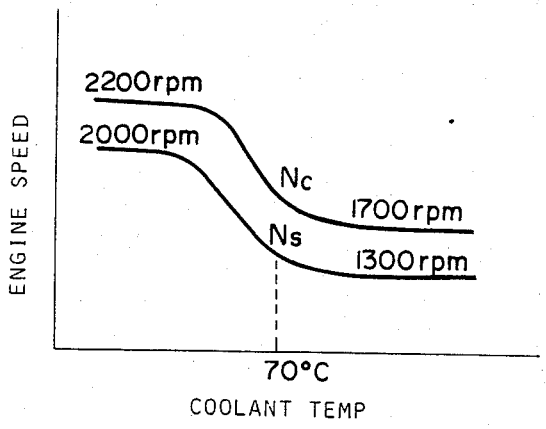
FIG. 8(C) is a graphical representation showing the relationship between fuel-cut engine speed and coolant temperature and between fuel-supply engine speed and coolant temperature.

FIG. 8(C) shows the relationship between the reference engine speed $N_c$ at which fuel can be cut and the reference engine speed $N_s$ at which fuel should be supplied and the engine coolant temperature. This figure indicates that when the engine coolant temperature drops below about 70° C., both the reference engine speeds $N_c$ and $N_s$ are determined to be higher values (e.g. 2000 to 2200 rpm).

Further, in the control program, these reference engine speeds $N_c$ and $N_s$ are read in table look-up method.

As described above, in the fuel cut-supply control system for a multiple-cylinder combustion engine according to the present invention, since the cylinders of the engine are divided into first and second cylinder groups and since fuel is cut off from or supplied to one cylinder group a predetermined time period after fuel has been cut off from or supplied to the other cylinder group whenever the engine is decelerated or accelerated, the delay time being so determined that engine vibration caused by the first engine cylinder group is 180 degrees out of phase with that caused by the second engine cylinder group, it is possible to markedly reduce the amplitude of engine vibration when fuel is cut off from or supplied to the engine. Therefore, it is possible to lower the lower limit of engine speed at which fuel can be cut, thus effectively economizing fuel, in addition to improvement in riding comfort.

It will be understood by those skilled in the art that the foregoing description is in terms of a preferred embodiment of the present invention wherein various changes and modifications may be made without departing from the spirit and scope of the invention, as set forth in the appended claims.

What is claimed is:

1. A fuel cut-supply control system for a multiple-cylinder internal combustion engine including a first engine cylinder group provided with a first fuel injection valve group and a second engine cylinder group provided with a second fuel injection valve group and a throttle valve, which comprises:

(a) intake air amount sensing means for detecting the amount of intake air introduced into the engine cylinders;

(b) engine speed sensing means for detecting the revolution speed of the engine;

(c) throttle valve position sensing means for detecting the opening position of the throttle valve to determine whether the engine is being accelerated or idled;

(d) fuel injection pulse generating means responsive to said intake air amount sensing means and said engine speed sensing means for calculating an appropriate pulse width of a fuel injection pulse signal applied to the first and second fuel injection valve groups to supply fuel;

(e) fuel cut-supply determining means responsive to said engine speed sensing means and said throttle valve position sensing means for outputting a fuel out command signal when engine speed is above a predetermined value and the opening position of the throttle valve corresponds to engine idling and a fuel supply command signal when the opening position of the throttle valve does not correspond to engine idling;

(f) delay circuit means responsive to said fuel cut-supply determining means for delaying the fuel cut command signal and the fuel supply command signal to such an extent that the engine vibration caused by the first engine cylinder group is 180 degrees out of phase with that caused by the second engine cylinder group when fuel is cut off or supplied;

(g) first fuel cut-supply control means responsive to said fuel injection pulse generating means and said fuel cut-supply determinating means for applying the fuel injection pulse signal to the first engine cylinder group in response to the fuel supply command signal and interrupting the fuel injection pulse signal in response to the fuel cut command signal; and (h) second fuel cut-supply control means responsive to said fuel injection pulse generating means and said delay circuit means for applying the fuel injection pulse signal to the second engine cylinder group in response to the delayed fuel supply command signal and interrupting the fuel injection pulse signal in response to the delayed fuel cut command signal, whereby engine vibration can be reduced in dependence upon destructive interference caused between the first and second engine cylinder groups.

2. A fuel cut-supply control system for a multiple-cylinder internal combustion engine including a first engine cylinder group provided with a first fuel injection valve group and a second engine cylinder group provided with a second fuel injection valve group and a throttle valve, which comprises:

(a) intake air amount sensing means for detecting the amount of intake air supplied into the engine cylinders;

(b) engine speed sensing means for detecting the revolution speed of the engine;

(c) throttle valve position sensing means for detecting the opening position of the throttle valve to determine whether the engine is being accelerated or idled; and (d) a microcomputer responsive to said intake air amount sensing means, said engine speed sensing means and said throttle valve position sensing means, for inputting sensing means signals indicative of the amount of intake air, revolution speed of the engine and the opening rate of the throttle valve, calculating an appropriate pulse width of a fuel injection pulse signal applied to the fuel injection valves to supply fuel, outputting a fuel cut command signal when engine speed is above a predetermined value and the opening position of the throttle valve corresponds to engine idling and a fuel supply command signal when the opening position of the throttle valve does not correspond to engine idling, delaying the fuel cut command signal and the fuel supply command signal to such an extent that the engine vibration caused by the first engine cylinder group is 180 degree out of phase with that caused by the second engine cylinder groups when fuel is cut off or supplied, applying the fuel injection pulse signal to the first engine group in response to the fuel supply command signal and interrupting the fuel injection pulse signal in response to the fuel cut command signal, and applying the fuel injection pulse signal to the second engine cylinder group in response to the delayed fuel supply command signal and interrupting the fuel injection pulse signal in response to the delayed fuel cut command signal, whereby engine vibration can be reduced in dependence upon destructive interference caused between the first and second engine cylinder groups.

3. A method of cutting fuel off from or supplying fuel to a multiple-cylinder internal combustion engine including a first engine cylinder group provided with a first fuel injection valve group and a second engine cylinder group provided with a second fuel injection valve group and a throttle valve, which comprises the following steps of:

(a) checking whether the engine is being idled by determining if the throttle valve is fully closed;

(b) if the engine is being idled, detecting engine speed and comparing the detected engine speed with a predetermined reference engine speed at which fuel can be cut;

(c) if the detected engine speed exceeds the reference fuel-cut engine speed, setting a delay time to a fuel-cut timer activated when the throttle valve is fully closed and cutting fuel off from the first engine cylinder group;

(d) decrementing the delay time set in the fuel-cut timer;

(e) if the decremented fuel-cut delay time reaches zero, further cutting fuel off from the second engine cylinder group;

(f) if the engine is not being idled, setting a delay time to a fuel-supply timer activated when the throttle valve is opened and supplying fuel to the second engine cylinder group;

(g) decrementing the delay time set in the fuel-supply timer; and (h) if the decremented fuel-supply delay time reaches zero, further supplying fuel to the first engine cylinder group.

4. A method of cutting fuel off from or supplying fuel to a multiple-cylinder internal combustion engine as set forth in either claim 3, wherein said reference engine speed at which fuel can be cut and said reference engine speed at which fuel should be supplied vary according to engine coolant temperature.

5. A method of cutting fuel off from or supplying fuel to a multiple-cylinder internal combustion engine as set forth in claim 3, which further comprises the following steps of:

(a) if the detected engine speed drops below the reference fuel-cut engine speed;

(b) comparing the detected engine speed with another predetermined reference engine speed at which fuel should be supplied;

(c) if the detected engine speed exceeds the reference fuel-supply engine speed and if fuel is being cut off from the first engine cylinder group, further cutting fuel off from the second engine cylinder group when the decremented fuel-cut delay time reaches zero;

(d) if the detected engine speed exceeds the reference fuel-supply engine speed but if fuel is not being cut off from the first engine cylinder group, supplying fuel to the first and second engine cylinder groups;

(e) if the detected engine speed drops below the reference fuel-supply engine speed, setting a delay time to the fuel-supply timer and supplying fuel to the second engine cylinder group; and (f) decrementing the delay time set in the fuel-supply timer and further supplying fuel to the first engine cylinder group when the decremented fuel-supply delay time reaches zero.

6. A method of cutting fuel off from or supplying fuel to a multiple-cylinder internal combustion engine as set forth in claim 5, wherein said reference engine speed at which fuel can be cut and said reference engine speed at which fuel should be supplied vary according to engine coolant temperature.

* * * * *